US006230676B1

(12) United States Patent
Pryba et al.

(10) Patent No.: US 6,230,676 B1
(45) Date of Patent: May 15, 2001

(54) INTERCHANGEABLE ROCKER ARM ASSEMBLY

(75) Inventors: Stanley J. Pryba, Toledo; Rodney E. DeLong; Terry R. Shook, both of Sylvania, all of OH (US)

(73) Assignee: Toledo Technologies Inc., Perrysburg, OH (US)

( * ) Notice: Subject to any disclaimer, the term of this patent is extended or adjusted under 35 U.S.C. 154(b) by 0 days.

(21) Appl. No.: 09/298,382

(22) Filed: Apr. 23, 1999

(51) Int. Cl.[7] ..... F01L 1/18

(52) U.S. Cl. ..... 123/90.39; 123/90.36; 74/559

(58) Field of Search ..... 123/90.36, 90.39, 123/90.41, 90.44; 74/519, 559

(56) References Cited

U.S. PATENT DOCUMENTS

| | | | | |
|---|---|---|---|---|
| 1,346,116 | * | 7/1920 | Waters | 123/90.36 |
| 1,617,986 | * | 2/1927 | Blank | 123/90.36 |
| 2,053,743 | * | 9/1936 | Russell | 123/90.36 |
| 3,146,767 | * | 9/1964 | Dadd | 123/90.36 |
| 3,410,366 | * | 11/1968 | Winter, Jr. | 123/90.36 |
| 4,245,523 | * | 1/1981 | Wherry | 74/519 |
| 4,630,576 | * | 12/1986 | Raymond | 123/90.36 |
| 4,655,177 | * | 4/1987 | Wells et al. | 123/90.36 |
| 4,718,379 | * | 1/1988 | Clark | 123/90.39 |
| 5,273,006 | | 12/1993 | Schäpertöns et al. . | |
| 5,325,825 | | 7/1994 | Schmidt et al. . | |
| 5,372,097 | | 12/1994 | Joseph et al. . | |
| 5,535,641 | | 7/1996 | Uchida et al. . | |
| 5,553,583 | * | 9/1996 | Jones | 123/90.36 |
| 5,596,958 | | 1/1997 | Miller . | |
| 5,678,305 | | 10/1997 | Nagano et al. . | |
| 5,678,459 | | 10/1997 | Motohashi et al. . | |
| 5,730,093 | | 3/1998 | Calka et al. . | |
| 5,774,984 | | 7/1998 | Kotani . | |

FOREIGN PATENT DOCUMENTS

| | | |
|---|---|---|
| 1538897 | 1/1979 | (GB) . |

* cited by examiner

*Primary Examiner*—Thomas Denion
*Assistant Examiner*—Tu M. Nguyen
(74) *Attorney, Agent, or Firm*—Rader, Fishman & Grauer PLLC

(57) ABSTRACT

A rocker arm assembly for an internal combustion engine includes a central mounting shaft and a rocker arm rotatably mounted to the central shaft wherein the rocker arm has a generally planar main body with a valve contacting end and a push rod contacting end. A convex surface is formed on a lower edge of a valve contacting surface and the push rod contacting end includes a generally semi-spherical recess that creates generally semi-spherical outer projections on the sides of the rocker arm main body. The central mounting shaft according to one embodiment of the present invention is a generally hollow, tubular shaft having spaced apart lubrication apertures for providing lubricant to each rocker arm. A second embodiment of the present invention has a central mounting shaft that includes a plurality of relatively short, hardened shafts connected together at respective adjoining ends by a spacer sleeve to provide a rocker arm assembly having greater stiffness.

10 Claims, 6 Drawing Sheets

INTERCHANGEABLE ROCKER ARM ASSEMBLY

FIELD OF THE INVENTION

The present invention relates to rocker arm assemblies for internal combustion engines and, in particular, to internal combustion engines for motor vehicles. The rocker arm assemblies of the present invention have unique lubrication systems and also permit both a bearingless and a roller bearing type rocker arm shaft assembly to be interchangeably mounted in a same engine.

BACKGROUND OF THE INVENTION

Rocker arm assemblies are utilized in internal combustion engines for alternately actuating intake and exhaust valves. As an engine cam shaft rotates, a push rod is selectively actuated by cams located on the cam shaft. The push rods, in turn, direct an upward force on one end of a rocker arm to cause the rocker arm to pivot about a mounting shaft. As the rocker arm pivots, its opposite end generates a downward force to selectively open an intake or exhaust engine valve.

Typically, rocker arms are integral, one-piece parts having a generally U-shaped cross-section including a pair of opposing side walls separated by a bottom wall and a pair of end walls disposed between the side walls. Rocker arms are conventionally either stamped or cast. The above described U-shaped rocker arms are commonly referred to as "boat-type" rocker arms. U-shaped rocker arms generally have adequate stiffness. However, the increased mass and width of U-shaped rocker arms negatively affects the moment of inertia, which is important for engine components reciprocating at very high frequencies. Increased mass also decreases vehicle fuel efficiency. Some other disadvantages of U-shaped rocker arms include loud operating noise, vibration, and undesirable levels of friction.

Lubrication in conventional U-shaped rocker arm assemblies is provided through hollow push rods that channel lubricant up to a lubricant aperture in one end of an adjacent rocker arm. Then lubricant flows onto the bottom wall in between the side walls of the rocker arm.

The previously known rocker arm assemblies include variations having so-called "frictionless" bearings and assemblies without bearings. However, none of the prior known devices allow a bearingless rocker arm shaft assembly to be interchanged with a frictionless bearing rocker arm shaft assembly within the same basic engine design configuration. The incompatibility of the prior art decreases engine manufacturer flexibility by forcing a selection between the higher costs associated with multiple engine design configurations or only being able to offer a single engine design with only one type of rocker arm s haft assembly.

Further, the prior art rocker arm designs lack the ability to have a rocker arm supplier provide a fully pre-assembled rocker arm shaft assembly that can be shipped to and installed at the engine manufacturer's assembly plant. Instead, the prior art designs require the engine manufacturer to pre-assemble the components. Thus, the prior art designs are more susceptible to having loose, individual component parts lost during shipping and handling. Moreover, the prior art designs increase inventory burden on the engine manufacturer and often result in inadequate rotation of parts in inventory.

SUMMARY OF THE INVENTION

The present invention is directed to a rocker arm assembly including a central mounting shaft having at least one rocker arm rotatably mounted to the central shaft. The rocker arm has a generally planar main body with first and second ends and first and second side surfaces and a central aperture that receives a tubular section. In addition, the first end of the rocker includes a convex surface for contacting a valve stem. The convex surface extends laterally beyond at least one of the first and second side surfaces of the planar main body.

The second end of the rocker arm includes a generally hollow recess formed adjacent an edge of the planar main body such that an outer projection is formed on each of the first and second side surfaces of the planar main body. The hollow recess receives an end of a push rod for transmission of forces from an engine cam shaft. Also, the tubular section of the rocker arm surrounds the central shaft and intersects the main body at a predetermined angle.

The present invention further provides an improved lubrication system for efficiently distributing lubricant to the valve stem contact surface of the rocker arm. In one embodiment of the present invention, a hollow central shaft has lubricant apertures that align with a lubricant bore provided in the rocker arm. The lubricant bore of the rocker arm extends from the central aperture of the rocker arm to a top edge of the rocker arm, near a high point or apex thereof Thus, lubricant is channeled up from the hollow central shaft through the rocker arm to an apex on its top edge before flowing downwardly toward the valve stem contact surface via a groove located on the outer edge of the rocker arm. Such a lubrication system permits fast delivery of lubricant because the lubricant flows over a shorter distance from an approximate center of the rocker arm to the valve stem contact surface.

According to a second embodiment of the present invention, another improved lubrication system is provided. In the second embodiment, a central mounting shaft is formed from a series of relatively short, hardened shafts connected together at respective adjoining ends by a joining spacer sleeve. The joining spacer sleeve includes a split for increasing clamping load to retain the adjoining ends of the shafts. Further, a lubrication flow channel is provided on the joining spacer sleeve to collect and direct lubricant toward an interface between the rocker arm and the central mounting shaft. In the second embodiment, lubricant flows through a hollow push rod, up through a lubricant aperture in one end of the rocker arm, and then to the valve stem contact end of the rocker arm via a groove in the rocker arm top surface. Lubricant also overflows from the groove and is caught in the channel of the joining spacer sleeve to direct lubricant toward roller bearing elements on which the rocker arms are mounted.

In addition, a thrust washer is optionally located on the central mounting shaft and has a central aperture for receiving the central shaft. The thrust washer has a recessed portion on an inside diameter to form a lubricant passageway through the thrust washer to lubricate a set of roller bearings that mount the rocker arm onto the central mounting shaft.

The rocker arm assemblies of the present invention have two piece rocker arms that are relatively thin, stamped plates connected to a tubular element. The different configuration of the present rocker arms, (e.g., they are relatively thin compared to the prior art), allows a greater number of engine towers to be provided on an engine, resulting in greater overall system stiffness. In addition, lighter weight rocker arms have less reciprocating mass about the intake and exhaust valves, providing a lower moment of inertia and increased engine efficiency. Thus, the present rocker arm design reduces weight and noise and has a better moment of inertia than traditional U-shaped rocker arms.

In addition, a rocker arm subassembly is disclosed having a relatively short shaft with first and second ends and a plurality of through bores for attaching the shaft to an engine. Only first and second rocker arms are spaced apart on the short shaft and positioned for rotational movement. A spacer is located on the shaft between the first and second rocker arms to accurately position the first and second rocker arms. At least two of the relatively short shafts are connected together to form an engine rocker arm assembly.

Further, the present invention contemplates a complete assembly of rocker arms mounted on one or more shafts that can be shipped in a fully pre-assembled condition to an engine maker for ready installation into a cylinder head of an engine. The component parts of the rocker arm shaft assembly are securely held together, preventing unwanted loss of parts during shipping and handling. Further, the present invention permits a main body of the shaft assembly to be positioned on towers of an engine by allowing integral fasteners to move a predetermined distance relative to the main body, but preventing the fasteners from completely separating from the main body. Such an approach is in direct contrast to the prior art which has individual arms that are mounted to individual shafts at the engine maker's site.

BRIEF DESCRIPTION OF THE DRAWINGS

The features and inventive aspects of the present invention will become more apparent upon reading the following detailed description, claims, and drawings, of which the following is a brief description:

DETAILED DESCRIPTION OF PREFERRED EMBODIMENTS

Figure 1:
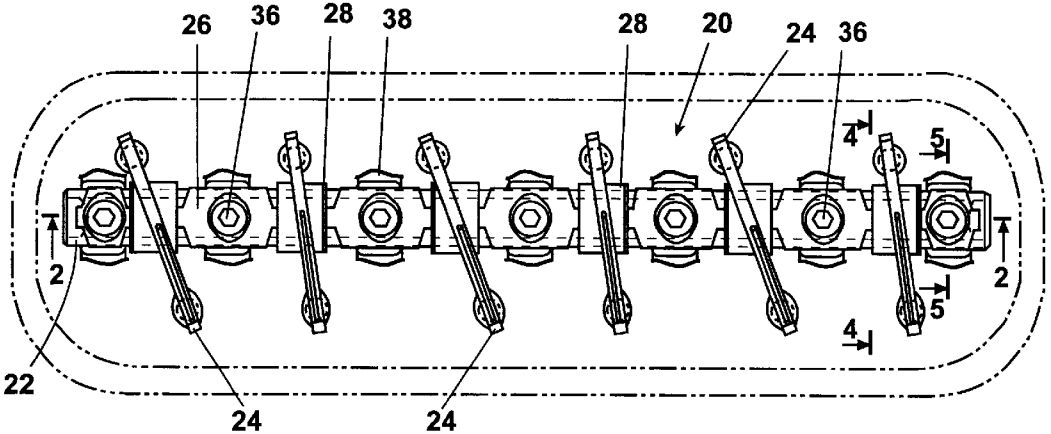
FIG. 1 is a top view of a rocker arm assembly according to the present invention.
Figure 3:
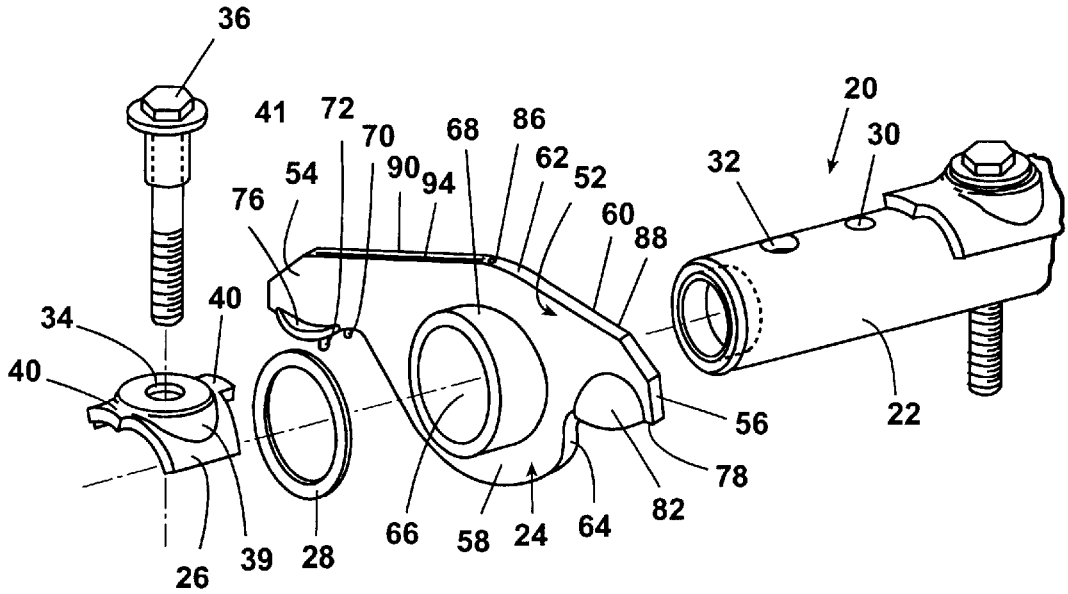
FIG. 3 is an exploded perspective view of a portion of a rocker arm assembly according to the present invention.

FIGS. 1 and 3 show a rocker arm shaft assembly 20 having a central mounting shaft 22 for rotatably supporting one or more rocker arms 24. A plurality of spacers 26 are attached to central mounting shaft 22 and correctly position rocker arms 24 along central shaft 22. In addition, one or more thrust washers 28 are provided between rocker arm 24 and an adjacent spacer 26 to reduce wear. Although thrust washer 28 is shown only on one side of each rocker arm 24, the present invention contemplates having thrust washers 28 on both sides rocker arm 24 or none at all. Moreover, rocker arms 24 are bearingless and directly contact central shaft 22 in a slip fit condition that allows rocker arm 24 to be assembled onto central shaft 22 but minimizes looseness in the connection during rocker arm rotation.

Figure 2:
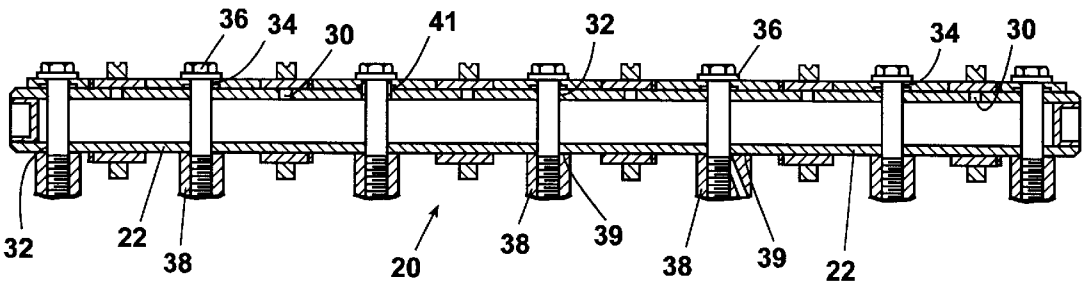
FIG. 2 is a cross-sectional side view taken along lines 2—2 of FIG. 1.

As shown in FIG. 2, central mounting shaft 22 is preferably hollow and includes a plurality of lubricant passageways 30 extending from an inner periphery to an outer periphery thereof to insure adequate lubrication for rocker arm assembly 20. Further, central shaft 22 includes a plurality of spaced apart through bores 32 positioned for corresponding alignment with a through bore 34 in spacer 26. A fastener 36 extends through spacer 26 and central shaft 22 for securely attaching rocker arm assembly 20 to a tower 38 of an engine block. Tower 38 projects upwardly from a cylinder head (not shown) and includes a generally semi-circular recess 39 that cradles and supports central shaft 22. Semi-circular recess 39 is dimensioned just slightly larger than central shaft 22 to permit assembly but prevent unwanted looseness or play.

FIG. 3 shows an exploded perspective view of the present invention. Spacer 26 is generally saddle-shaped having a semi-circular profile that is approximately the same diameter as the outside diameter of central shaft 22 for containment of the central shaft 22. Spacer 26 is shaped and dimensioned to at least partially seal the upper surface of central shaft 22 near bores 32 to permit central shaft 22 to be pressurized and prevent lubricant loss through bores 32. A central upwardly projecting boss 39, which includes through bore 34, is provided on spacer 26 to create adequate surface engagement area for fastener 36. In addition, each central longitudinal end of spacer 26 includes an outwardly extending projecting tab 40 that is dimensioned to precisely space apart rocker arms 24 while limiting the amount of surface area contact for reduced frictional contact with thrust washer 28 or rocker arm 24.

Figure 5:
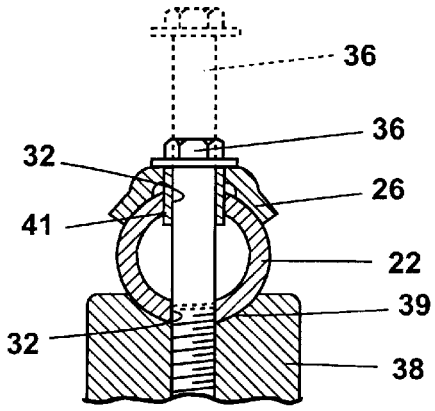
FIG. 5 is a cross-sectional view taken along lines 5—5 of FIG. 1.

Optionally, but preferably, as shown in FIGS. 2 and 3, a ferrule or collar 41 is provided on fastener 36 and performs the tasks of retaining spacer 26 and fastener 36 on central shaft 22. Ferrule 41 has an outer diameter dimensioned to slip fit in spacer bore 34 and press fit into shaft through bore 32, thereby retaining spacer 26 to shaft 22. An inner diameter of ferrule 41 is dimensioned to allow limited vertical movement of fastener 36 as shown in FIG. 5, but prevent complete removal of fastener 36. Thus, as main shaft 22 is positioned on tower 38, fastener 36 is able to move vertically to a position that does not interfere with installation. Also, ferrule 41 prevents fastener 36 from backing out or being completely separated from the rocker arm shaft assembly 20. Thus, ferrule 41 extends into central shaft 22 in press fit engagement with through bores 32 to attach spacer 26 to shaft 22 and retain fastener 36 with limited travel.

Figure 6:
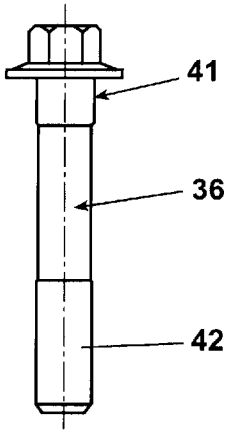
FIG. 6 is a side view of a fastener having a ferrule.
Figure 7:
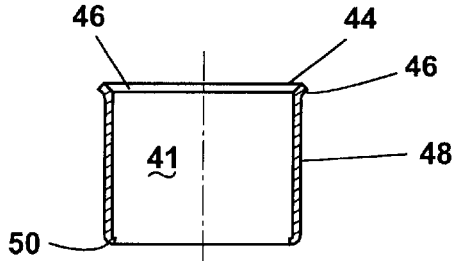
FIG. 7 is a cross-sectional side view of a ferrule according to the present invention.

FIGS. 6 and 7 illustrate further design details of ferrule 41. FIG. 6 shows fastener 36 having a threaded portion 42 at one end thereof. Ferrule 41 has an inner diameter smaller than or equal to the threaded portion 42 diameter, preventing total removal of fastener 36 from ferrule 41. Preferably, ferrule 41 is placed on fastener 36 prior to rolling of threaded portion 42. FIG. 7 shows ferrule 41 in cross-section having one end 44 including a flared portion 46 for mating engagement with a corresponding chamfer in spacer 26. Thus, when ferrule 41 is press fit into shaft 22, flared portion 46 captures and retains spacer 26 relative to shaft 22. In addition, ferrule 41 includes slightly tapering side walls 48 terminating at a second end 50. Side walls 48 are tapered to facilitate insertion into bores 32, 34 and permit a wider range of manufacturing tolerances that result in the same basic assembly conditions. Therefore, ferrule 41 provides an important function that allows a rocker arm supplier to fully pre-assemble a rocker arm shaft assembly that has all of the necessary parts, including fasteners, which can then be shipped to an engine manufacturer's plant without losing component parts. Moreover, no parts are lost during handling and installation into an engine.

As best shown in FIG. 3, rocker arm 24 includes a main body 52 that is a generally planar, stamped, flat plate having a valve contact end 54 and a push rod contact end 56. Also, main body 52 includes first and second side surfaces 58, 60 and top and bottom peripheral edges 62, 64. A central aperture 66 extends from main body 52 for receiving a tubular section 68 at any angle that is suitable for properly aligning rocker arm 24 with its associated engine valve and push rod. Angles range from 90° to any acute angle. Tubular section 68 has at least a portion extending laterally outwardly from either one or both sides 58, 60 of main body 52. Tubular section 68 can be staked, brazed, laser welded, or otherwise suitably connected to main body 52 to form a lever type rocker arm 24. In addition, main body 52 has a predetermined length that accurately positions rocker arm 24 with an adjacent push rod and engine valve. By varying the angle of main body 52 relative to tubular section 68 and/or the length of main body 52, rocker arms 24 are able to be designed to precisely engage valves in almost any engine geometry layout, including offset valves.

Figure 4:
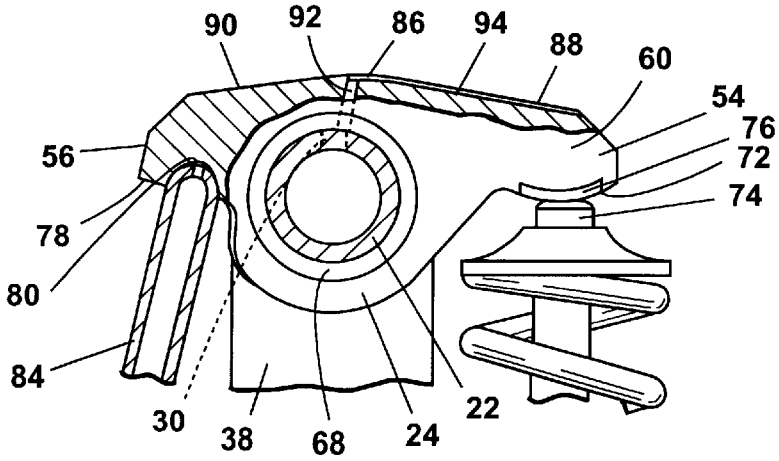
FIG. 4 is a cross-sectional view taken along lines 4—4 of FIG. 1.

Valve contact end 54 of rocker arm 24 includes a lower edge 70 having a convex valve contact surface 72 for contacting an end of a valve stem 74 as shown in FIG. 4. Valve contact surface 72 is preferably formed by plastically deforming material on lower edge 60 such that portions 76 extend laterally beyond the first and second side surfaces 58, 60 of main body 52.

Push rod contact end 56 of rocker arm 24 includes a lower edge 78 having a generally hollow semi-spherical recess 80 formed therein such that a generally semi-spherical outer projection 82 is formed on each of the first and second side surfaces 58, 60 of main body 52. Semi-spherical recess 80 is adapted to receive a push rod 84 as show in FIG. 4. Preferably, push rod 84 is hollow to provide lubrication to semi-spherical recess 80 for reducing wear caused by friction. Alternatively, if a solid push rod is utilized, then a mechanism for lubricating the interface should also be included.

Top edge 62 of rocker arm 24 includes an apex 86 defined by at least two angled surfaces 88, 90 on either side. Optionally, but preferably, a lubricant bore 92 extends from apex 86 down through tubular section 68 for establishing fluid communication with a respective lubricant passageway 30 in central mounting shaft 22. Further, a lubrication groove 94 extends along top edge 62 from lubricant bore 92 toward first end 54 to provide lubricant to convex valve contact surface 72. In addition, an optional lubrication groove can be provided along top edge 62 extending from lubricant bore 92 toward second end 56, if desired.

As shown in FIG. 4, lubricant passageway 30 is preferably several times larger than rocker arm lubricant bore 92 to permit lubricant to flow freely to lubricant bore 92 throughout the range of angular operating positions of rocker arm 24. In addition, lubricant is able to flow around the interface between rocker arm 24 and central shaft 22. By providing a lubricant passageway 30 through central shaft 22 and up through a centrally located lubricant bore 92 in a rocker arm 24. Moreover, a more efficient lubrication system is provided by the present invention because lubricant is introduced at a high point of rocker arm 24 and travels a shorter distance to first end 54 where convex contact surface 72 engages a valve stem 74.

FIGS. 8 through 13 illustrate a second embodiment according to the present invention having a rocker arm assembly 120 that includes one or more rocker arms 124 mounted onto a central mounting shaft 122 using a bearing element 123, including for example, a plurality of needle bearings, roller bearings, or bushing material. However, any suitable bearing element can be used. Rocker arm assembly 120 further includes a plurality of spacer sleeves 126 and one or more thrust washers 128 disposed between rocker arm 124 and spacer sleeve 126 to reduce wear caused by side thrust loads. In contrast to thrust washer 28, the second embodiment's thrust washer 128 includes one or more recesses or notches 129 provided on the inner diameter for providing a lubrication passageway to bearing element 123, as described in greater detail below.

Central mounting shaft 122 includes a plurality of relatively short, hardened, solid shafts 125. Each solid shaft 125 is connected to an adjoining solid shaft 125 by one of the spacer sleeves 126 that accommodates a pair of fasteners 130. Each spacer sleeve 126 is generally a cylindrical tubular element that has a flattened portion 132 that includes one or two through bores 134 for receiving fastener 130. Through bore 134 and through bore 133 in central shaft 122 are generally the same size and are only slightly larger than fastener 130 to ensure a tight connection. Similar to the first embodiment, it is contemplated that a ferrule 141 can be used to retain fastener 130, spacer sleeve 126 and central shaft 122. Alternatively, through bores 132 can be threaded to prevent unwanted removal or loss of fasteners 130 during shipping, handling, and installation. In addition, spacer sleeve 126 includes a split defined by a generally longitudinal slot 136 for providing increased clamping load when fastener 130 is tightened. Slot 136 additionally defines a lubrication channel that collects and directs lubricant toward bearing element 123.

To provide interchangeability between rocker arm assembly 20 and rocker arm assembly 120, spacer sleeves 126 have an outer diameter that is preferably substantially the same as the outside diameter of central mounting shaft 22 of rocker arm assembly 20. Thus, central mounting shaft 22 and central mounting shaft 122 are designed to accurately fit in the same semi-circular recesses 39 of towers 38 for a given engine. The present invention allows an engine manufacturer to provide different types of rocker arm assemblies in a same basic engine design.

Central mounting shaft 122 of the second embodiment has greater stiffness and improved hardenability. In addition, processing of relatively short shafts is easier because they are less susceptible to warpage and bending during hardening processes compared to a single relatively long solid shaft. Non-limiting examples of hardening processes that are contemplated to be used with the present invention include: heat treatment, induction hardening, through hardening, carburizing, nitriding, etc. Therefore, the present invention allows tighter tolerances to be maintained because the relatively short shaft segments 125 have very low distortion during manufacturing. Moreover, the overall rocker arm assembly 120 has a greater system stiffness than a single solid shaft version. Improved stiffness increases bearing life and reduces the effects of cyclic loading.

Figure 13:
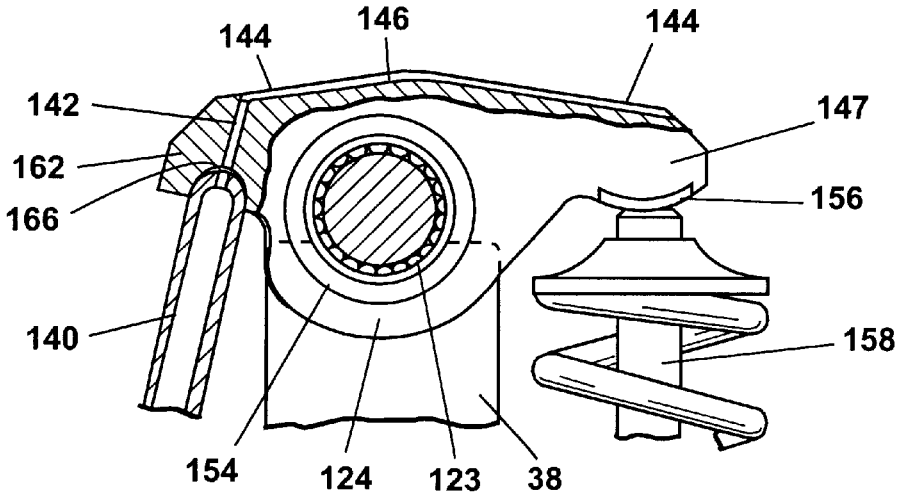
FIG. 13 is a cross-sectional view taken along line 13—13 of FIG. 8.

Lubrication for rocker arm assembly 120 is initially provided through a hollow push rod 140 as illustrated in FIG. 13. Next, lubricant flows through a lubricant bore 142 in rocker arm 124. Lubricant 142 is connected to a generally longitudinal lubricant groove 144 formed along a top edge 146 of rocker arm 124. Lubricant groove 144 extends from lubricant bore 142 toward valve contact end 147. In addition, as rocker arm 124 oscillates during operation, lubricant is thrown in multiple directions. Longitudinal slot 136 in spacer sleeve 126 tends to collect lubricant, which is able to flow to bearing element 123 when one of the recesses 129 of thrust washer 128 is aligned with longitudinal slot 136.

Figure 9:
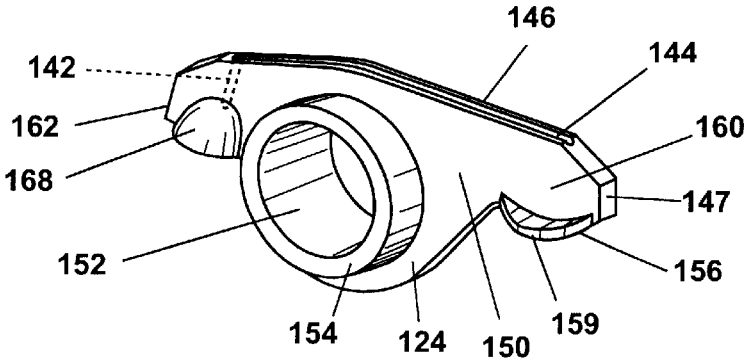
FIG. 9 is a perspective view of a rocker arm according to the present invention.
Figure 8:
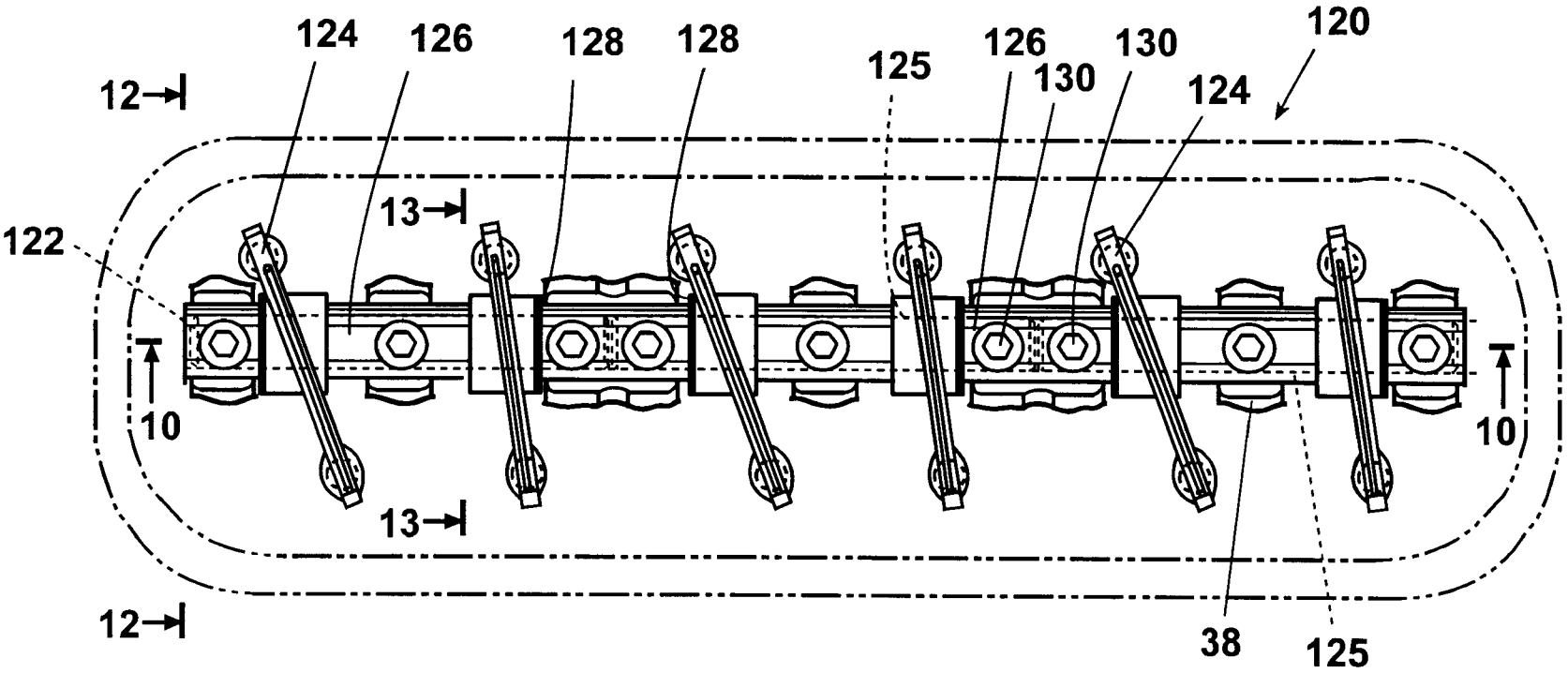
FIG. 8 is a top view of a rocker arm assembly according to another embodiment of the present invention.
Figure 10:
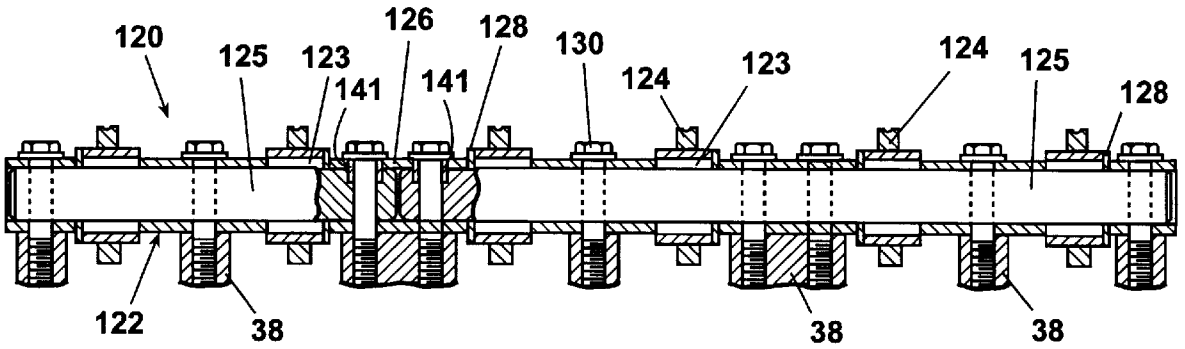
FIG. 10 is a cross-sectional view taken along line 10—10 of FIG. 8.
Figure 11:
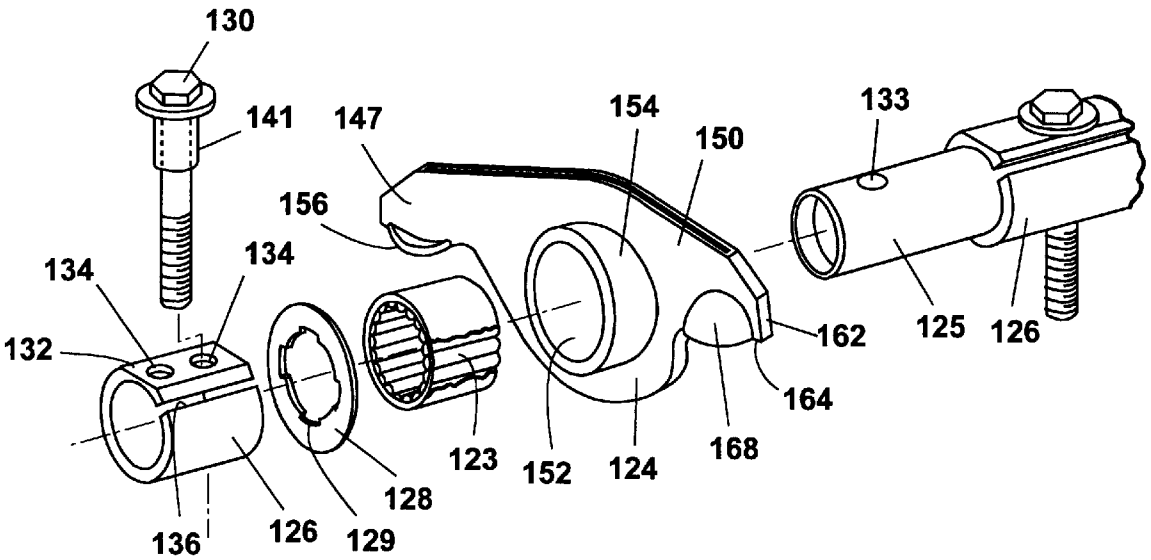
FIG. 11 is an exploded perspective view of a portion of a rocker arm assembly according to the second embodiment of the present invention.
Figure 12:
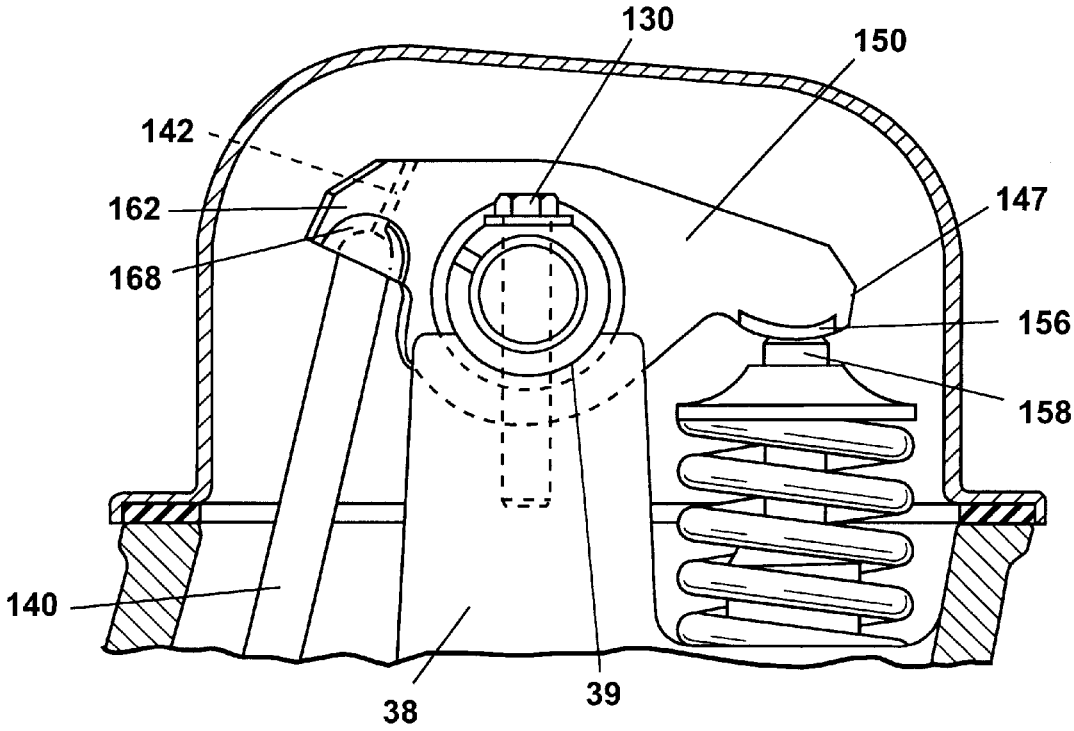
FIG. 12 is a cross-sectional view taken along line 12—12 of FIG. 8.

Similar to rocker arm 24 of the first embodiment, rocker arm 124 includes a main body 150 that is generally planar, stamped flat plate having a central aperture 152 to receive a tubular section 154. Tubular section 154 can be attached to main body 150 at any desired angle by staking, brazing, laser welding, or any other suitable attachment technique. Valve contact end 147 of rocker arm 124 has a convex valve contact surface 156 for contacting a valve stem 158. As illustrated in FIGS. 9 and 11, valve contact surface 156 includes laterally extending portions 159 that extend laterally beyond side surfaces 160 of main body 150. In addition, push rod end 162 of rocker arm 124 has a lower edge 164 with a generally hollow semi-spherical recess 166 formed therein such that a generally semi-spherical outer projection 168 is formed on respective side surfaces 160 of main body 150. Semi-spherical recess 166 receives push rod 140.

Although the present invention has been described having lubricant apertures located in the central region of the rocker arm as in the first embodiment, it is alternatively contemplated that the lubricant aperture be located in the push rod end of the rocker arm and a hollow push rod is used for introducing lubricant to the rocker arm. In addition, although it is preferred to use a series of relatively short shafts that are connected together for the second embodiment of the present invention, it is also contemplated that a single solid shaft can be used in combination with the rocker arms of the present invention to achieve a suitable rocker arm assembly.

Although the present invention can be fabricated using any suitable materials, preferably the rocker arm assembly is fabricated from metal, especially steel.

Preferred embodiments of the present invention have been disclosed. A person of ordinary skill in the art would realize, however, that certain modifications would come within the teachings of this invention. Therefore, the following claims should be studied to determine the true scope and content of the invention.

What is claimed is:

1. A rocker and assembly comprising:

a central mounting shaft having spaced apart lubrication apertures;

at least one bearingless rocker arm rotatably mounted to said central shaft;

said rocker arm having a generally planar main body with first and second ends and first and second side surfaces, a central aperture, a lubricant bore extending through said central aperture to a top portion of said main body and aligned with one of said lubrication apertures, and a lubrication groove formed along a top edge of said rocker arm and extending from said lubricant bore to said first end of said rocker arm;

said first end of said rocker arm including a surface for contacting a valve stem, said surface extending laterally beyond at least one of said first and second side surfaces of said planar main body, said lubrication groove delivering lubricant to said valve stem;

said second end of said rocker arm including a generally hollow recess formed adjacent an edge of said planar main body such that an outer projection is formed on each of said first and second side surfaces of said planar main body, said hollow recess provided for receiving an end of a push rod;

a tubular section of said rocker arm surrounding said central shaft and intersecting said main body at a predetermined angle such that said rocker arm is positioned at a non-perpendicular angle with respect to said central shaft; and wherein said central mounting shaft is an elongated hollow shaft having spaced apart lubrication apertures that are aligned with, and provide lubricant to said lubricant bore of said rocker arm.

2. The rocker arm assembly of claim 1, wherein said tubular section is positioned in said central aperture, said tubular section directly contacting an end portion of said central mounting shaft with a slip fit condition.

3. The rocker arm assembly of claim 1, further comprising a ferrule and a spacer connected to said central mounting shaft, said ferrule having a predetermined inside diameter for limiting movement of a fastener and a predetermined outside diameter for retaining said spacer on said central mounting shaft.

4. The rocker arm assembly of claim 1, wherein a spacer is secured to said central shaft and positioned adjacent to said rocker arm to position said rocker arm with respect to said central shaft.

5. A rocker arm assembly comprising:

a central mounting shaft having a plurality of spaced apart through bores;

at least one bearingless rocker arm having a central aperture for rotatably mounting said rocker arm to said central shaft;

a lubricant bore provided in said rocker arm and extending through said rocker arm to a top portion of said rocker arm and fluidly connected to said central aperture;

a lubrication groove extending from said lubrication bore and extending along said top portion of said rocker arm toward a first end of said rocker arm; and at least one spacer having a through bore for receiving a fastener, said spacer attached to said central mounting shaft such that said through bore of said spacer is aligned with at least one of said through bores of said central mounting shaft so as to accurately position said rocker am along said central shaft; and wherein said central mounting shaft is an elongated hollow shaft having spaced apart lubrication apertures that are aligned with, and provide lubricant to said lubricant bore of said rocker arm.

6. The rocker arm assembly of claim 5, further comprising a ferrule connected to said central mounting shaft, said ferrule having a predetermined inside diameter for limiting movement of a fastener and a predetermined outside diameter positioned in said through bore for retaining said spacer on said central mounting shaft.

7. The rocker arm assembly of claim 5, wherein said rocker arm further includes a generally planar main body with first and second ends and first and second side surfaces and wherein said central aperture receives a tubular section.

8. The rocker arm assembly of claim 7, wherein said rocker arm further includes a first end with a convex surface for contacting a valve stem, said convex surface extending laterally beyond at least one of said first and second side surfaces of said planar main body.

9. The rocker arm assembly of claim 7, wherein said second end of said rocker arm includes a generally hollow semi-spherical recess formed adjacent an edge of said planar main body such that a semi-spherical outer projection is formed on each of said first and second side surfaces of said planar main body, said hollow recess provided for receiving an end of a push rod.

10. The rocker arm assembly of claim 7, wherein said lubricant bore extends from an outer edge of said rocker arm through said tubular section for establishing fluid communication with said lubrication aperture in said central mounting shaft.

* * * * *